US007004619B2

(12) United States Patent
Papi

(10) Patent No.: US 7,004,619 B2
(45) Date of Patent: Feb. 28, 2006

(54) SEAT CORRECTING MECHANISM FOR SPRUNG BALANCE REGULATING DEVICE

(75) Inventor: Giulio Papi, La Chaux-de-Fonds (CH)

(73) Assignee: Audemars Piguet (Renaud et Papi) S.A., Le Locle (CH)

( * ) Notice: Subject to any disclaimer, the term of this patent is extended or adjusted under 35 U.S.C. 154(b) by 0 days.

(21) Appl. No.: 11/165,036

(22) Filed: Jun. 24, 2005

(65) Prior Publication Data

US 2006/0007789 A1 Jan. 12, 2006

(30) Foreign Application Priority Data

Jul. 8, 2004 (EP) ..... 04016102

(51) Int. Cl.
*G04B 15/00* (2006.01)
*G04B 17/20* (2006.01)

(52) U.S. Cl. ..... 368/127; 368/170

(58) Field of Classification Search ..... 368/124, 368/125, 127, 168–175
See application file for complete search history.

(56) References Cited

U.S. PATENT DOCUMENTS 5,608,694 A * 3/1997 Grimm et al. ..... 368/127
5,838,641 A * 11/1998 Tohkoku et al. ..... 368/127
6,367,965 B1 * 4/2002 Kiu ..... 368/127

FOREIGN PATENT DOCUMENTS

| | | |
|---|---|---|
| CH | 25659 | 4/1902 |
| CH | 593 832 A5 | 8/2002 |
| CH | 693 047 A5 | 1/2003 |

* cited by examiner

*Primary Examiner*—Vit W. Miska
(74) *Attorney, Agent, or Firm*—Sughrue Mion, PLLC

(57) ABSTRACT

The regulating device, represented by its escapement wheel (5), is kept horizontal by being supported by a platform (3) secured to a counterweight (9) rotatably mounted about an arbour $A_1$, pivoting in a carriage (10) rotatably mounted about an arbour $A_2$ perpendicular to the arbour $A_1$. Escapement wheel 15 meshes with a driving wheel (6) secured to arbour $A_1$ and forming the output of a first differential (11) having at its inputs a kinematic corrective chain (8, 12, 14, 16, 18) and a kinematic drive chain, itself connected to the output of a second differential (21) having at its inputs the barrel wheel (7) and another kinematic corrective chain (22, 24, 26, 28) meshing with a wheel (20) secured to the carriage (10). The device can also act on an automatic winding block (40).

15 Claims, 4 Drawing Sheets

SEAT CORRECTING MECHANISM FOR SPRUNG BALANCE REGULATING DEVICE

This application claims priority from European Patent Application No. 04016102.8 filed Jul. 8, 2004, the entire disclosure of which is incorporated herein by reference.

FIELD OF THE INVENTION

The present invention concerns a seat correcting mechanism for a mechanical timepiece sprung balance regulating device, for reducing, or even removing, rate variations resulting from spatial orientation changes of said regulating device, as is the case for a wristwatch or for a pocket watch.

BACKGROUND OF THE INVENTION

"Rotating" regulating systems are already known, wherein the regulating device is mounted in a suspended rotating carriage, that may comprise one or two pivoting arbours or staffs, said carriage being permanently driven, for example by the third wheel. CH Patent No. 256 59 discloses a single staff "carrousel" movement for a timepiece with centre seconds, driven by the third wheel pinion, the balance-staff being shifted with respect to the pivoting arbour of the carriage.

CH Patent No. 693 047 discloses a "tourbillon" mechanism, whose carriage is pivoted on two perpendicular arbours so that it can take a large number of positions, the sprung-balance staff then being centred on a pivoting axes, the assembly still being driven by an intermediate wheel receiving its driving energy from the barrel.

There also exist "tourbillon" mechanisms wherein three pivoting axes are provided, as disclosed for example in CH Patent No. 693 832.

In all cases, it will be observed that rotation of the carriage incorporating the regulating device is a forced movement. In other words, this rotation of the carriage requires additional energy from the motor member, namely the barrel, even when this is not necessary, for example when the timepiece is at rest, for example when placed on a table for the night.

Moreover, it will be observed that the movements imposed on the carriage can theoretically and statistically compensate for rate variations, but, when the watch is worn on the wrist, there is nothing to prevent the regulating device remaining in a given position long enough to cause a significant gain or loss. In other words, there is no interaction between the permanent rotational movement imposed on the tourbillon and the spatial orientation of the watch, and thus of its regulating device, when it is worn on the wrist.

SUMMARY OF THE INVENTION

The invention thus concerns a seat correcting mechanism for a regulating device, i.e. a mechanism that holds the assortment comprising the escapement wheel, pallets, roller and more particularly the sprung balance in an essentially fixed plane, whether it be horizontal, vertical or with an intermediate inclination, and whatever movements are imposed on the watch by being worn on the wrist, without relying on the energy from the motor member, namely the barrel.

According to another aspect of the invention, not only is the barrel no longer required to provide energy, but it may, conversely, receive energy from the seat correcting mechanism, as will be explained hereinafter.

The invention thus concerns a seat correcting mechanism for a platform supporting a regulating device for a mechanical timepiece, comprising in particularly a balance spring driven by an escapement wheel, wherein said platform is suspended in a carriage about an arbour $A_1$, while being secured to a counterweight, rotating freely about arbour $A_1$, holding said platform in an essentially fixed plane when the carriage is inclined in a perpendicular plane to arbour $A_1$. Said escapement wheel meshes with a drive wheel secured to arbour $A_1$, and driven in rotation by the barrel wheel indirectly by a kinematic drive chain, and by a gear train forming a corrective kinematic chain meshed with a wheel secured to the counterweight to make said drive wheel rotate in the same direction and at the same speed as the counterweight.

A first differential device connects the drive wheel and the kinematic drive and corrective chains.

The carriage itself pivots in a frame secured to the watchcase along an arbour $A_2$ located in a perpendicular plane to arbour $A_1$, couple from the barrel wheel being indirectly transmitted to the drive wheel via an intermediate pinion constituting the output of a second differential device meshing with the barrel wheel and with a corrective drive chain meshed with a toothed wheel secured to the carriage.

Thus, however the watch is inclined in a perpendicular plane to arbour $A_1$, or to arbour $A_2$, or to an intermediate direction, the counterweight or counterweight carriage positions the platform, and thus the whole of the regulating device, in a constant position imposed by the counterweight or the counterweight assembly, parasitic couple being removed by the corrective kinematic chains.

BRIEF DESCRIPTION OF THE DRAWINGS

The invention will be better understood upon reading the following description, given by way of illustrative and non-limiting example, with reference to the annexed drawings, in which.

DETAILED DESCRIPTION OF THE INVENTION

In the following description, it is assumed that the mechanism is mounted in the case of a mechanically wound wristwatch and that the regulating device is required to be held in an essentially horizontal position.

Figure 2:
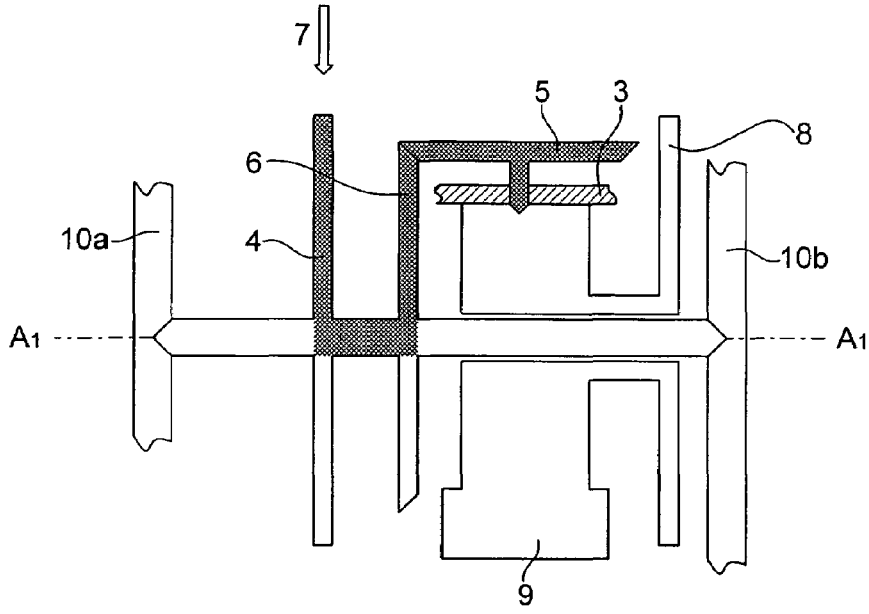
FIG. 2 illustrates the principle of the kinematic drive chain between the barrel wheel and the escapement wheel.
Figure 3:
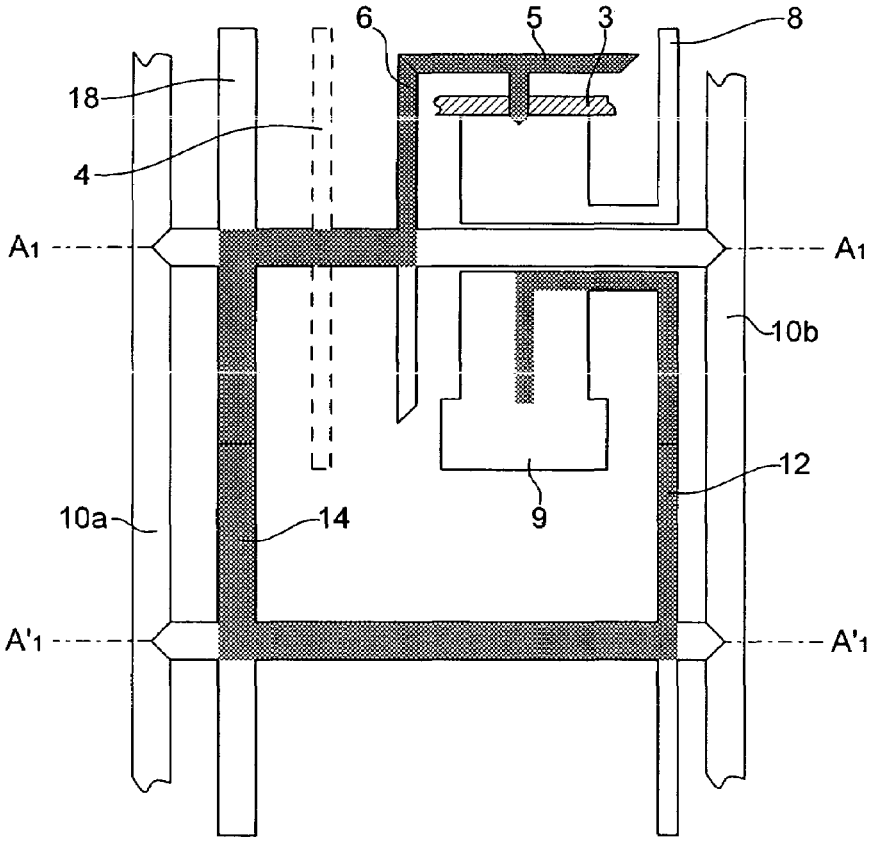
FIG. 3 illustrates the principle of the kinematic corrective chain between the escapement wheel and the counterweight.

The principle of the seat correcting mechanism is first of all described with reference to FIGS. 1 to 3.

Figure 1:
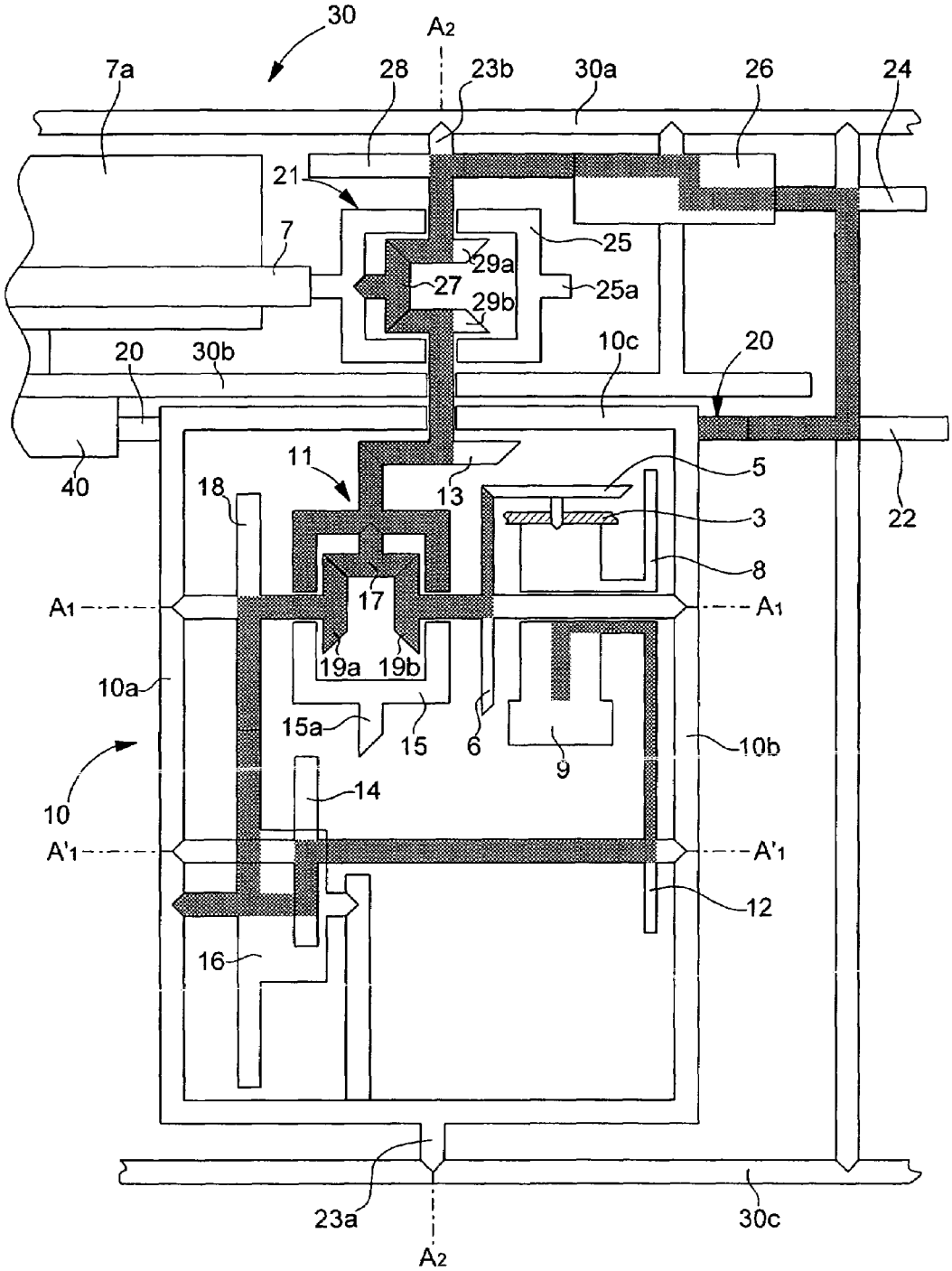
FIG. 1 shows a schematic overall view of an embodiment of a seat correcting mechanism according to the invention.

FIG. 1 is a schematic overall view comprising a carriage 10 in which there is arranged a platform 3 supporting the usual assortment of a regulating device represented in the Figures by escapement wheel 5, the sprung balance and other elements of the assortment not being shown. "Platform" means a rigid support that is generally but not necessarily flat. Platform 3 is secured to the top part of a counterweight 9, formed for example by a brass weight. Counterweight 9 is mounted to rotate freely on an arbour $A_1$, pivoted between two panels 10*a*, 10*b* of carriage 10. Thus, when carriage 10 is inclined by the wrist moving in a perpendicular plane to arbour $A_1$, counterweight 9 holds platform 3 in a horizontal position, and thereby the entire assortment, particularly the sprung balance and escapement wheel 5 in the example shown.

Referring more particularly now to the kinematic drive chain shown in FIG. 2, which is a partial enlarged view, there is schematic diagram of the kinematic chain for transmitting the torque from the barrel wheel to escapement wheel 5, schematically represented by an arrow 7, which drives a wheel 4 secured to arbour $A_1$, wheel 4 actually being fictitious as will be explained hereinafter. The couple is transmitted via arbour $A_1$, to a drive wheel 6 meshed with escapement wheel 5 by a conical gear. When carriage 10 is inclined, as previously indicated, a parasitic couple is created on escapement wheel 5, due to the rotation of counterweight 9 about arbour $A_1$. The mechanism is provided in order to compensate for this parasitic couple as explained with reference to the kinematic corrective chain shown in FIG. 3.

As regards the corrective chain, a wheel 8 secured to counterweight 9 meshes with a wheel 12, mounted on an arbour $A_1$, pivoting between plates 10*a*, 10*b* of carriage 10 and parallel to arbour $A_1$ supporting at its other end a wheel 14, which itself meshes with a wheel 18 secured to arbour $A_1$ and is thus able to transmit the couple to escapement wheel 5 via drive wheel 6.

The number of wheels and gear ratios of the chain thereby formed are such that drive wheel 6 has the same speed and same rotational direction as wheel 8.

In the example shown, there is an uneven number of independent wheels 8, 12/4, 18 and since wheels 8, 18 on the one hand and wheels 12, 14 on the other hand respectively have the same number of teeth, the aforementioned condition is fulfilled, but other choices are evidently also possible. Thus the device that has just been described allows escapement wheel 5 to be held immobile when counterweight 9 undergoes a rotation about arbour $A_1$, assuming of course that there is no couple exerted by the kinematic drive chain.

Figure 4:
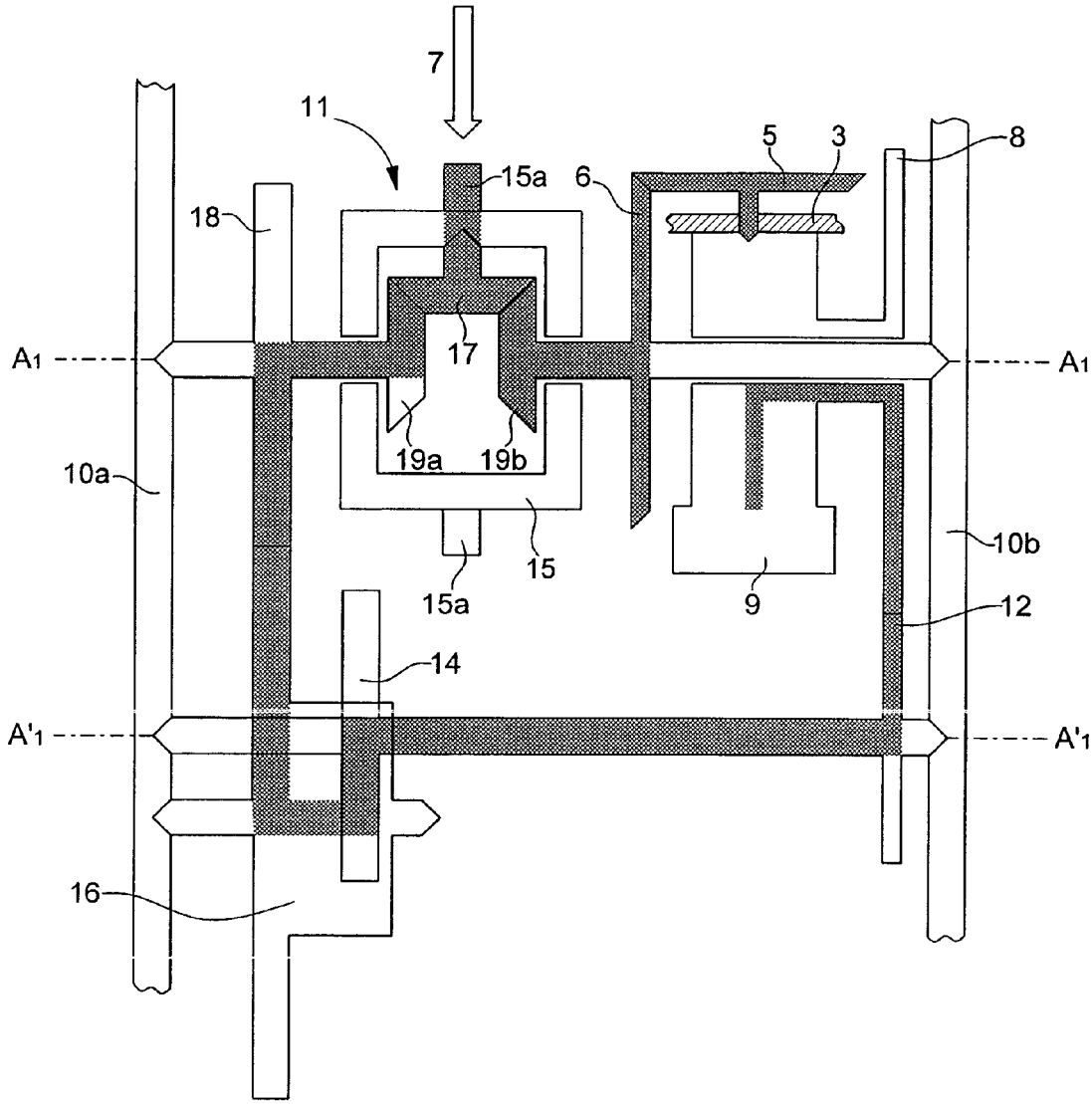
FIG. 4 shows the connection between the kinematic chains of FIGS. 2 and 3.

Referring now to FIG. 4, there is shown the connection between the two kinematic, drive and corrective chains, which have just been described with reference to FIGS. 2 and 3.

As can be seen, fictitious wheel 4 is replaced by a differential 11 having a power take-off for the kinematic drive chain, a power take-off for the corrective kinematic chain and an output meshing with drive wheel 6. Differential 11 shown is formed of conical gear planetary wheels. It comprises a planetary wheel carrier 15 provided on its outer wall with a toothed ring 15*a* in direct or indirect mesh with barrel wheel 7. Planetary wheel carrier 15 comprises a first planetary wheel 17 with a conical toothing pivoting in free rotation at a point of the inner wall of planetary wheel carrier 15. A second conical planetary wheel 19*a* meshing with the first planetary wheel 17 pivots on an arbour in the extension of arbour $A_1$, passing through the bottom of planetary wheel carrier 15 and supporting wheel 18 of the kinematic corrective chain. A third conical planetary wheel 19*b* mounted on arbour $A_1$, and meshing with first planetary wheel 17, drives with the drive wheel as a function of the couple received from the kinematic drive and corrective chains. Given that the differential 11 shown introduces a reversion of the rotational direction, a reverser pinion with a double toothing designated by the reference 16 has to be provided on the kinematic chain from wheel 8 of counterweight 9 to drive wheel 6, the number of teeth of the intermediate wheels being such that the driving wheel 8 and the driven wheel 6 have the same speed and the same rotational direction. It is of course possible to provide a direction reverser device at any other place on the kinematic chains, including in reverser 11 itself. Other types of differential could also be envisaged, for example a differential with double planetary wheels that does not require the insertion of a direction reverser in the corrective chain.

In the example shown in FIG. 4, the three conical pinions 17, 19*a*, 19*b* have the same diameter and transmit the speeds of the drive and corrective chain without any modification. It is, however, possible to act on the gear ratios of these three mobiles, depending upon the particular constraints of a given construction.

In the preceding description, the seat correction of platform 3 was described along a single direction. Returning to FIG. 1, it can be seen that seat correction along a second direction is possible in accordance with the same principle as that which has just been described. Carriage 10 is rotatably mounted between two pivots 23*a*, 23*b* in bridges and/or plates 30*a*, 30*b*, 30*c* of case 30 of the wristwatch along an arbour $A_2$ perpendicular to the general plane of the watch and thus to arbour $A_1$. In the example shown the lower plate 10*c* includes a pivot 23*a* pivoting in an element 30*c* of the frame, and facing a pivot 23*b* pivoting in another element 30*a* of the frame.

Carriage 10 and the elements that it contains, act like a second counterweight for holding platform 3 in a horizontal position when the watch is inclined by the wrist moving in a perpendicular plane to arbour $A_2$. Given that the biggest weight of this second counterweight is counterweight 9 itself, arbour $A_2$ will preferably not be secant with arbour $A_1$, to increase the moment driving the rotation of carriage 10.

As previously, there is a kinematic drive chain from barrel wheel 7 and a kinematic corrective chain from a wheel 20 secure to top plate 10*c* of carriage 10, said wheel 20 able to be integral with plates 10*c*, these two kinematic chains being connected by a second differential 21.

Differential 21 is formed of mobiles 25*a*, 27, 29*a* and 29*b* similar to those already described for first differential 11 and it will not, therefore, be described any further. It comprises a drive force output from barrel 7*a* formed by a conical gear 13 which meshes with conical toothing 15*a* of planetary wheel carrier 15 of the first differential 11 for transmitting the motor torque to drive wheel 6. Likewise, the second differential 21 comprises an input connected to wheel 20 of carriage 10 by a gear train 22, 24, 26, 28 designed with the same constraints as before and which will not, therefore, be described any further.

Thus it can be seen that the mechanism that has just been described enables platform 3 to be held horizontally however the watch is inclined in perpendicular planes to arbours $A_1$ or $A_2$, and evidently along any other intermediate inclination, such that the sprung balance regulating device is not subjected to any influence by the watch's spatial orientation.

To improve comprehension of the invention, the mobiles that could actually be fused, for example to make the device more compact, have deliberately been made independent. By way of non-limiting example, escape wheel 5 and drive wheel 6 could form a single mobile.

According to another aspect of the invention, the movement of carriage 10 could be similar to that of an oscillating mass and it is possible for the toothing of wheel 20 of carriage 10 to mesh with an automatic winding block 40, which in a way enables the energy to be "recovered" along arbour $A_2$.

Figure 5:
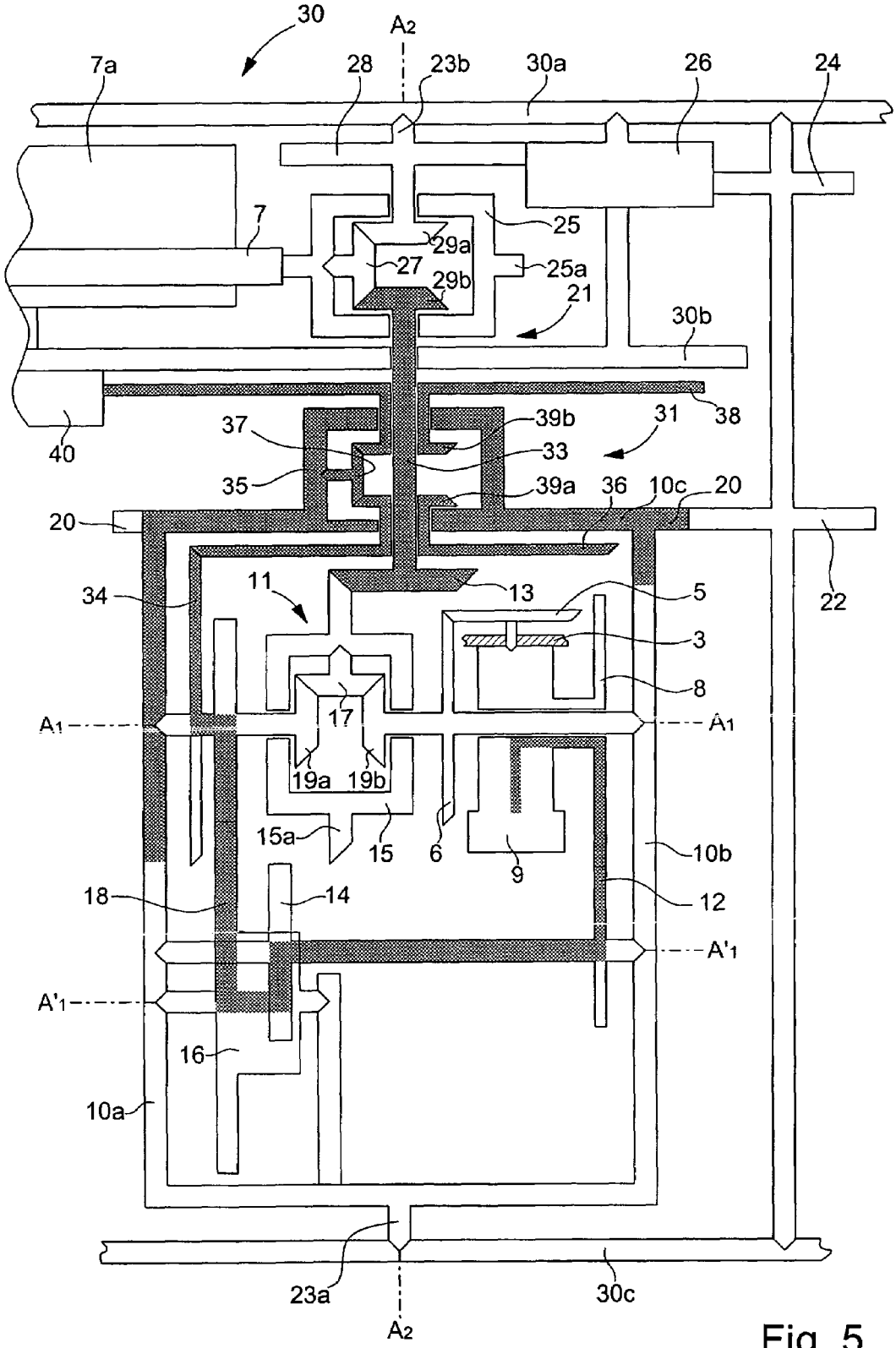
FIG. 5 shows a variant in which the seat corrector is coupled to an automatic winding block.

According to a variant shown in FIG. 5, it is also possible to "recover" the energy for the automatic winding block along arbour $A_1$. For this purpose, a third differential 31 is inserted also comprising mobiles 37, 39*a*, 39*b* comparable to those previously described, and planetary wheel carrier 35 is integral with top plate 10*c*. The first power take-off along arbour $A_1$ is achieved by means of an additional wheel 34 secured to said arbour $A_1$ and meshing via a conical gear with a wheel 36 driving planetary wheel 39*a* and intermediate planetary wheel 37. The second power take-off along arbour $A_2$ is formed by the planetary wheel carrier 35 secured to top plate 10*c* of carriage 10. A wheel 38 secured to planetary wheel 39*b* and meshing with automatic winding block 40 forms the output of differential 31. This third differential 31 differs from the preceding two differentials 11, 21 only in that an arbour 33 passes therethrough connecting intermediate wheel 13 meshing with first differential 11 and planetary wheel 29*b* of the second differential 21.

This variant, in a simplified form, could even have the single function of automatically winding along two axes.

It will be observed finally that the mobiles and differentials of the mechanism that has just been described also enable the couple and rotational speed of escapement wheel 5, or any other member of the regulating device, to be adjusted very easily.

What is claimed is:

1. A seat correcting mechanism for a platform supporting a regulating device of a mechanical timepiece including in particular a sprung balance driven by an escapement wheel, characterised in that said platform is suspended in a carriage about an arbour $A_1$, while being secured to a counterweight, rotating freely about arbour $A_1$, holding said platform in an essentially fixed plane when the carriage is inclined in a plane substantially perpendicular to the arbour $A_1$, and in that the escapement wheel is in mesh with a drive wheel secured to arbour $A_1$ and driven in rotation by a barrel wheel by a motor kinematic chain and by a gear train forming a kinematic corrective chain in meshing with a wheel secured to the counterweight in order to rotate the drive wheel in the same direction and at the same speed as said counterweight.

2. The seat correcting mechanism according to claim 1, wherein the differential device includes two power take-offs and an output is inserted between the drive wheel and the kinematic drive and corrective chains.

3. The seat correcting mechanism according to claim 2, wherein a first differential device includes a planetary wheel carrier provided with a toothed wheel meshing with the wheel driven by the barrel wheel and housing a planetary wheel mounted to rotate freely and meshing, on the one hand with a planetary wheel, and on the other hand with a planetary wheel in meshing with the drive wheel.

4. The seat correcting mechanism according to claim 2, wherein the differential device or the gear train further include a set of rotational direction reverser gears.

5. The seat correcting mechanism according to claim 1, wherein the carriage also pivots in a frame secured to the watchcase along an arbour $A_2$ located in a substantially perpendicular plane to arbour $A_1$, wherein the couple from the barrel wheel is directly or indirectly transmitted to the drive wheel by an intermediate pinion, and wherein the carriage and the elements that it supports form a counterweight holding the platform in a horizontal position when the frame is inclined in a perpendicular plane to arbour $A_2$.

6. The seat correcting mechanism according to claim 5, wherein a second differential device is inserted between the intermediate pinion and the barrel wheel.

7. The seat correcting mechanism according to claim 6, wherein a gear train connects the second differential device and a toothed wheel secured to the carriage.

8. The seat correcting mechanism according to claim 7, wherein the second differential device or the gear train includes a set of rotational direction reverser gears.

9. The seat correcting mechanism according to claim 7, wherein the second differential device is formed of a planetary wheel carrier having an external toothed wheel and planetary wheels acting like those of the first differential.

10. The seat correcting mechanism according to claim 1, wherein the platform secured to the counterweight has a horizontal position.

11. The seat correcting mechanism according to claim 1, wherein the escapement wheel and the drive wheel are merged, the platform then essentially supporting the sprung balance.

12. The seat correcting mechanism according to claim 7, wherein the toothed wheel secured to the carriage drives an automatic winding block when the frame is inclined in a perpendicular plane to the arbour $A_2$.

13. The seat correcting mechanism according to claim 12, wherein a third differential device is inserted between the carriage and the frame, said device including a power take-off along the arbour $A_1$, and a power take-off along the arbour $A_2$ for driving an automatic winding block whatever inclination is imparted to the frame.

14. The seat correcting mechanism according to claim 13, wherein the third differential device is similar to the first two differential devices.

15. The seat correcting mechanism according to claim 14, wherein it includes a planetary wheel carrier secured to the plate of the carriage, said planetary wheel carrier being secured to an external wheel driving the automatic winding block.

* * * * *